United States Patent [19]

Lieber et al.

[11] Patent Number: 4,505,958

[45] Date of Patent: Mar. 19, 1985

[54] METHOD FOR HOT DIP GALVANIZING METALLIC WORKPIECES

[75] Inventors: Hans-Wilhelm Lieber; Roland Kammel, both of Berlin, Fed. Rep. of Germany

[73] Assignee: Hermann Huster GmbH & Co., Hagen, Fed. Rep. of Germany

[21] Appl. No.: 378,473

[22] Filed: May 14, 1982

[30] Foreign Application Priority Data

May 22, 1981 [DE] Fed. Rep. of Germany ..... 3120401
Jan. 20, 1982 [DE] Fed. Rep. of Germany ..... 3201475

[51] Int. Cl.[3] ..... B05D 1/18

[52] U.S. Cl. ..... 427/433; 427/329; 427/406; 427/156

[58] Field of Search ..... 427/329, 433, 406, 156

[56] References Cited

U.S. PATENT DOCUMENTS 547,381 10/1895 McKnight ..... 427/329
1,378,439 5/1921 Baskerville ..... 427/329 X
3,730,758 5/1973 Laidman ..... 427/156
3,925,579 12/1975 Flinchum et al. ..... 427/320
3,936,543 2/1976 Byrd et al. ..... 427/320
4,115,604 9/1978 Bernstein ..... 427/329

OTHER PUBLICATIONS

*Tin and its Alloys* Edited by: Ernest S. Hedges ©1960, Ernest S. Hedges p. 353.

*A new Dictionary of Chemistry* Edited by: L. Mackenzie Miall 3rd ed. ©1961, Longmans Green & Co., Ltd., p. 224.

*Primary Examiner*—John E. Kittle
*Assistant Examiner*—James J. Seidleck
*Attorney, Agent, or Firm*—Spencer & Frank

[57] ABSTRACT

Process for hot dip galvanizing workpieces of steel or iron materials wherein a treatment with fluxing agent is omitted. After being cleaned, the workpieces are coated with a thin metal layer which replaces the previously customarily applied fluxing agent layer and are immersed into the zinc melt with their surfaces in the dry state.

21 Claims, 1 Drawing Figure

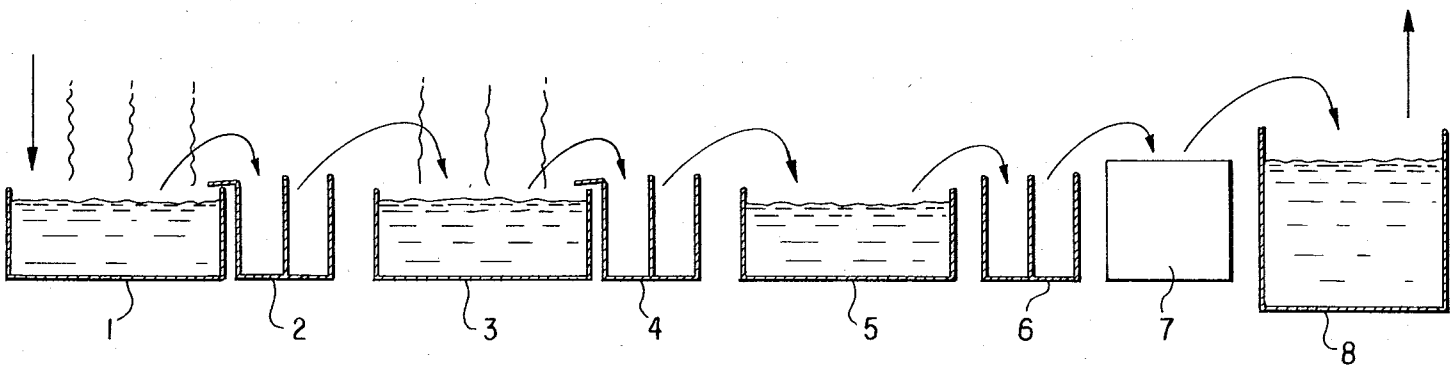
1
2
3
4
5
6
7
8

METHOD FOR HOT DIP GALVANIZING METALLIC WORKPIECES

BACKGROUND OF THE INVENTION

The present invention relates to a method for hot dip galvanizing metallic workpieces by dipping them into a zinc melt, the workpieces being subjected to a pretreatment for cleaning their surfaces and coating them with an intermediate layer which assures a reaction with the zinc melt over the entire surface of the workpieces and wherein the workpieces are dipped into the zinc melt with their surfaces in a dry state and are removed from the zinc melt after a predetermined period of time. Such a method is disclosed in East German Patent No. 124,923.

Metallic workpieces as used in the present invention are workpieces of steel or iron materials which can be protected against corrosion by immersing them into a zinc melt. Depending on their size, the workpieces are immersed into the zinc melt either individually or simultaneously in larger quantities. In the prior art hot dip galvanizing process, the workpieces are pretreated on their surfaces and then coated with the desired zinc layer by immersing them into a zinc melt. Conventional zinc melts essentially comprise zinc and generally about 1% lead as well as metals, such as aluminum, iron, cadmium, copper and tin, as alloying elements or impurities, respectively.

Before being immersed into a hot dip galvanizin vessel, the workpieces must be pretreated in such a manner that their surfaces can be wet everywhere by the molten zinc. Such a pretreatment is the only way to assure that the zinc melt can react uniformly with the surfaces of the workpieces to form a complete, uninterrupted coating thereon.

The pretreatment of the workpiece surfaces can be performed in various ways. If steel strip is to be hot dip galvanized in a continuous passage, the pretreatment is usually a heat treatment process as disclosed, for example, in German Offenlegungsschrift No. 2,537,298 and corresponding U.S. Pat. No. 3,936,543, and in British Patent No. 1,496,398 and corresponding U.S. Pat. No. 3,925,579. In such a process it is necessary for the bright-annealed steel surface formed by the heat treatment to not come into contact with air before being immersed into the zinc melt so that the steel surface remains free of oxides. When hot dip galvanizing individual metallic workpieces, such thermal pretreatment is hardly feasible because of the apparatus involved. Therefore, such workpieces are usually pretreated in aqueous solutions, and less frequently by mechanical means, i.e. blasting.

Generally, the workpieces must first be degreased and in this way made wettable by water. Alkaline degreasing and cleaning solutions are customary for this purpose. After degreasing, the workpieces are rinsed in water. Thereafter, they are dipped into a pickling bath and after pickling they are rinsed again. To simplify the process, it is also possible in certain cases, to perform a so-called combined pickling/degreasing step, in which case the separate degreasing and rinsing can be omitted. Pickling is effected, for example, in diluted hydrochloric acid or in diluted sulfuric acid.

If the workpieces are to be wet-galvanized in a zinc melt, they are usually first immersed in acid and then sent wet through a flux coating, which is floating on the zinc melt, into the liquid zinc. See East German Patent No. 124,923. If, however, the so-called dry galvanizing process is employed, the workpieces are immersed in a solution of a fluxing agent and then dried, so that the workpiece surface is coated with a layer of fluxing agent. Only then are the workpieces dipped into the liquid zinc melt. To obtain a thinner zinc layer during the galvanizing process, and thus save zinc, East German Patent No. 124,923 proposes to precipitate copper on the steel surface before or during the immersion of the workpieces in the fluxing agent solution. This additionally applied copper layer is intended only to reduce the thickness of the zinc layer. The use of a fluxing agent cannot be left out.

The reaction of the fluxing agent with the workpiece surface during the immersion into the zinc melt produces a violent pickling effect which is considered necessary in hot dip galvanizing processes to obtain a uniform and complete zinc coating. This reaction results in a heavy emission of pollutants, such as, for example, ammonia, hydrochloric acid, ammonium chloride, zinc oxide and zinc chloride. Moreover, the immersion of the workpieces into the zinc melt produces large quantities of zinc ash and scrapings on the surface of the zinc melt which must be removed by skimming before the workpieces are pulled out of the zinc melt. This causes great losses of zinc. Moreover, the contaminants which ascend in the smoke leaving the zinc melt have a considerable impact on the environment. It is therefore necessary to collect the smoke and remove the contaminants by purification so that the exhaust gas can be made harmless. The removal of such contaminants, for example with the aid of gas purification systems, requires a large amount of apparatus.

Due to the poor conditions for emission purification, attempts have been made for years to develop and use low-smoke fluxing agents so as to reduce the contaminant content of the exhaust gas. In these attempts, different fluxing agents were employed, i.e., for example, solutions of different salts. Such salts are generally more expensive than the classical salts, zinc chloride and ammonium chloride, so that the costs are higher. Moreover, the use of low-smoke fluxing agents still involves a considerable amount of contaminant emission. Additionally, low-smoke fluxing agents cannot be used universally because, for some charges, it is necessary to subsequently add a sprinkling of ammonium chloride. Then there remains the drawback that large quantities of zinc ash and scrapings are developed which must be removed from the surface of the zinc melt and this leads to high zinc losses.

SUMMARY OF THE INVENTION

It is an object of the present invention to provide a process with which metallic workpieces can be easily coated with a firmly adhering zinc layer without polluting contaminants being developed during the immersion.

Additional objects and advantages of the present invention will be set forth in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose the present invention provides a process for fluxless hot dip galvanizing metallic workpieces by immersing them in a zinc melt, the workpieces being subjected to a pretreatment which includes cleaning the surfaces of the workpieces and coating the surfaces of the workpieces with a reactive layer which assures a reaction with the zinc melt on the entire workpiece surface, and wherein the workpieces are immersed in the zinc melt with their surfaces in the dry state and are removed from the zinc melt after a predetermined period of time, comprising applying a thin metal layer to the workpieces as the reactive layer before immersing the workpieces in the zinc melt, and thereafter immersing the workpieces in the zinc melt without a prior fluxing agent treatment.

It is to be understood that both the foregoing general description and the following detailed description are exemplary, but are not restrictive of the invention.

BRIEF DESCRIPTION OF THE DRAWINGS

The sole drawing figure schematically illustrates a system for carrying out the process according to the present invention.

DETAILED DESCRIPTION OF THE INVENTION

The process of the present invention is based on the discovery that the fluxing agent treatment which has been used in the past to provide a fluxing agent layer as an intermediate layer to assure a reaction with the zinc melt on the entire workpiece surface can be omitted by replacing the fluxing agent layer with a thin metal layer.

The process of the present invention has a number of advantages. The emission of polluting contaminants is avoided by the practice of the present invention since no fluxing agent is used in the process. Further, the costs required to remove such contaminants or reduce their development, respectively, are no longer incurred. The process therefore operates in a nonpolluting manner. Moreover, zinc ash and scrapings are no longer produced on the surface of the zinc metal as a result of the immersion of the metallic workpieces so that the losses of zinc resulting therefrom no longer occur. The surfaces of the zinc-coated workpieces are free of ash and fluxing agent residues and therefore have better corrosion resistance and lacquerability.

Although a fluxing agent coating is omitted, the process of the present invention results in perfect, firmly adhering zinc coatings on the workpieces. This fact must be considered to be particularly surprising since the experts in the art have thought for decades that the prior treatment with a fluxing agent was absolutely necessary for workpiecces to be hot galvanized in a dip process as supported by the continuous efforts to develop low-smoke fluxing agents.

In principle, all metals which protect the pickled workpiece surface against oxidation in such a manner that a reaction with the zinc melt can take place on the entire workpiece surface are suitable for coating the workpiece with the thin metal layer which is to replace the previously always applied fluxing agent layer. Suitable metals are, for example, aluminum, lead, cadmium, copper, nickel, bismuth, zinc, tin and also alloys of these metals, such as, for example, copper-tin (bronze), copper-zinc (brass), or bismuth-antimony. The thin metal layer can be applied, for example, by electrochemical deposition, metal deposition by ion exchange (cementation), contact metallization, chemically reductive (electroless) deposition, or by way of mechanical or physical processes such as, for example, rubbing on, dusting on or vapor deposition.

Exemplary of a metal deposition by ion exchange is an electroless copper deposition by dipping a steel specimen into a solution of a copper salt leading to the reaction $$Cu^{2+} + Fe \rightarrow Cu + Fe^{2+}.$$

Contact metallization is similar to electroless metal deposition by ion exchange with the aid of an auxillary metal in contact with the substrate metal. Thus, the only difference is that in contact metallization a non-noble auxillary metal is kept in "contact" with the metal to be coated. The auxillary metal delivers the electrons necessary for reduction of the metal ions to be deposited on the specimen. As an example, if steel is to be coated with copper by an electroless reaction and a deposit of, e.g. 1 μm thickness is desired, such a layer thickness will not be attained by mere ion exchange between the steel specimen and the copper ions because the deposit will cover the steel substrate completely and the ion exchange reaction will thus be stopped. But if further electrons are delivered from an auxillary metal, e.g. zinc, the copper deposition can easily be continued and a thicker copper layer will be deposited.

The thickness of the thin metal layer on the workpieces can be very small. Preferably it should be below 1 μm. The thin metal layer protects the workpiece against oxidation until the hot dip galvanizing step is performed and maintains the surface of the workpiece in good condition for fast reaction with the zinc melt. Surprisingly, it is not necessary for this protective thin metal layer to be free of pores. Thus, the protective thin metal layers employed in the present invention need not be closed in themselves but can have pores.

The process according to the present invention will be described below for an embodiment which is illustrated in the drawing.

Initially, the workpieces are placed into a tank 1 in which they are degreased until their surfaces can be wetted with water. Thereafter, the workpieces are rinsed to remove the residues of the degreasing solution from the workpiece surfaces. A rinsing cascade 2 can be used for rinsing in which the workpieces are rinsed with water. The rinsing cascade 2 can preferably be arranged in such a manner that the water overflows into tank 1 so that evaporation losses in the degreasing bath can be compensated in this way. After rinsing in cascade 2, the workpieces are brought into a tank 3 containing a pickling bath which, like the degreasing solution is operated at elevated temperature and has evaporation losses. These evaporation losses can likewise be replenished by a subsequent rinsing cascade 4 in which the workpieces are rinsed after pickling.

Then the workpieces are provided with the thin metal layer in a coating bath 5. This coating bath 5 may be, for example, an electrochemical bath. After leaving coating bath 5, the workpieces are rinsed in a further rinsing cascade 6, and then dried in a drying station 7. Thereafter, they may be immersed into a zinc melt which is present in a vessel 8. After a sufficiently long, predetermined time, the workpieces are removed from the zinc melt and cooled, In this way, they are completely coated with a firmly adhering zinc layer. In the practice of the present invention, the workpieces can be exposed, to atmospheric air or other oxidizing gases after the thin metal layer is applied and before being immersed in the zinc melt. Thus, in the practice of the present invention, single discrete noncontinuous workpieces can be immersed into the zinc melt individually, or simultaneously in larger quantities, and can be handled in the ambient atmosphere without employing a protective atmosphere.

The coating bath 5, the rinsing cascade 6, and the drying station 7 are necessary only if the thin metal layer is not applied dry to the surface of the workpiece. If the metal layer is applied, for example, by brushing or dusting on, they can be omitted. In that case, a mechanically operating device takes the place of coating bath 5.

The cleaning of the workpiece surface can be combined with the application of the thin metal layer. Thus, the thin metal layer can then be deposited simultaneously with a pickling/degreasing process in tank 1. In this mode of operation, the workpieces are transported directly to drying station 7 after being rinsed in rinsing cascade 2.

All metals which assure that a reaction with the zinc melt takes place on the entire workpiece surface are suitable for the thin metal layer taking the place of the previously used fluxing agent layer as the intermediate layer applied to the cleaned surface of the workpieces. For example, aluminum, antimony, lead, cadmium, copper, nickel, zinc, tin and bismuth can be used. Alloys of these metals are also suitable. The thin metal layer may be applied electrochemically, chemically reductively, by cementation, by contact metallization, mechanically or physically. Layer thicknesses of less than 1 μm are sufficient.

Three examples for implementing the process according to the invention will be listed below:

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

Workpieces of steel are cleaned in a warm alkaline degreasing solution at about 90° C. until they can be wet by water. The alkaline degreasing solution can comprise an aqueous solution of salts, such as soda ash, sodium carbonate, sodium phosphate and the like, with surfactants or wetting agents, such as, sodium dodecyl sulfate, sodium benzene sulfonate and the like. Then the workpieces are rinsed to remove the residues of the degreasing solution from their surfaces. Thereafter, the workpieces are pickled in a pickling bath, for example in 12% sulfuric acid with added inhibitor, at about 60° C. until the oxides are completely removed from the workpiece surfaces. The inhibitor can be butynediol present in an amount of 0.2% and acts to restrain the attack of the acid against the steel workpiece and to accelerate removal of oxides. Then the workpieces are rinsed again.

Thereafter, a thin tin layer is applied to the workpieces as an intermediate reactive layer. The tin layer is deposited by contact metallization with zinc as the contact metal. The thickness of the tin layer is about 0.3 μm. Then the workpieces are rinsed, dried and finally dipped into the zinc melt. After an immersion time of about 5 minutes, the workpieces are removed from the zinc melt and cooled.

EXAMPLE 2

Steel parts are degreased as in Example 1, are rinsed, pickled and rinsed. Then, they enter into a solution of 8% hydrochloric acid with 70 mg/l antimony (III) chloride. In this solution, they are provided, at room temperature with an antimony deposit of about 0.1 μm thickness. Rinsing, drying, hot dip galvanizing and cooling are the same as in Example 1.

EXAMPLE 3

Workpieces of steel are degreased and pickled at room temperature in a pickling-degreasing solution of 80 g/l hydrochloric acid, 50 ml/l emulsifier mixture and 1 g/l copper sulfate. The emulsifier mixture can be a commercial product such as "TRINORM Fe" sold by Schering AG, Berlin, or can be an aqueous mixture of emulsifying agents, such as, for example, polyethylene gylcol and dodecylsulfonate. The treatment in the pickling-dereasing solution provides the workpieces with a copper layer of about 0.12 μm thickness. Rinsing, drying, hot dip galvanizing and cooling are the same as in Example 1.

It will be understood that the above description of the present invention is susceptible to various modifications, changes and adaptations, and the same are intended to be comprehended within the meaning and range of equivalents of the appended claims.

What is claimed is:

1. Process for fluxless hot dip galvanizing steel and ferrous metallic workpiece by immersing them in a zinc melt, the workpieces being subjected to a pretreatment which includes cleaning the surfaces of the workpieces and coating the surfaces of the workpieces with a reactive layer which assures a reaction with the zinc melt on the entire surfaces of the workpieces, and wherein the workpieces are immersed in the zinc melt with their surfaces in the dry state and are removed from said zinc melt after a predetermined period of time, comprising: applying a thin metal layer to the workpieces as the reactive layer and immersing the workpieces in the zinc metal, wherein said workpieces are immersed in the zinc melt after rinsing and drying, if necessary, but without a prior fluxing agent treatment and without chemical treatment between the application of the thin metal layer and immersing the workpieces in the zinc melt.

2. Process as defined in claim 1, wherein the thin metal layer is applied to the workpieces in a pickling-degreasing solution.

3. Process as defined in claim 1 or 2, wherein the thin metal layer has a thickness of less than 1 μm.

4. Process as defined in claim 1, wherein the thin metal layer contains pores.

5. Process as defined in claim 1, wherein the thin metal layer is applied electrochemically.

6. Process as defined in claim 1, wherein the thin metal layer is applied chemically reductively.

7. Process as defined in claim 1, wherein the thin metal layer is applied by cementation.

8. Process as defined in claim 1, wherein the thin metal layer is applied by contact metallization.

9. Process as defined in claim 1, wherein the thin metal layer is applied mechanically.

10. Process as defined in claim 1, wherein the thin metal layer is applied physically.

11. Process as defined in claim 1, wherein the thin metal layer is a layer of aluminum, antimony, lead, cadmium, copper, nickel, bismuth, zinc, tin or an allow thereof.

12. A process as defined in claim 1, wherein the thin metal layer is a layer of aluminum, antimony, cadmium, copper or zinc.

13. Process as defined in claim 1, wherein the thin metal layer is applied by a currentless method.

14. A process as defined in claim 1, wherein said thin metal layer is applied dry and the workpieces are immersed directly into the zinc melt without first rinsing and drying.

15. Process as defined in claim 2, wherein the thin metal layer contains pores.

16. Process as defined in claim 2, wherein the thin metal layer is applied electrochemically.

17. Process as defined in claim 2, wherein the thin metal layer is applied chemically reductively.

18. Process as defined in claim: 2, wherein the thin metal layer is applied by cementation.

19. Process as defined in claim 2, wherein the thin metal layer is applied with contact metallization.

20. Process as defined in claim 2, wherein the thin metal layer is applied mechanically.

21. Process as defined in claim 2, wherein the thin metal layer is applied physically.

* * * * *